US011335285B2

(12) United States Patent
Wang et al.

(10) Patent No.: US 11,335,285 B2
(45) Date of Patent: May 17, 2022

(54) CIRCUIT AND METHOD FOR ADJUSTING DISPLAY BRIGHTNESS LEVEL TO DISPLAY IMAGE WITH AN IMPROVED HOMOGENIZATION EFFECT

(71) Applicant: BOE TECHNOLOGY GROUP CO., LTD., Beijing (CN)

(72) Inventors: Long Wang, Beijing (CN); Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 453 days.

(21) Appl. No.: 16/475,114

(22) PCT Filed: Jan. 7, 2019

(86) PCT No.: PCT/CN2019/070652
§ 371 (c)(1),
(2) Date: Jun. 30, 2019

(87) PCT Pub. No.: WO2019/210705
PCT Pub. Date: Nov. 7, 2019

(65) Prior Publication Data

US 2021/0407446 A1 Dec. 30, 2021

(30) Foreign Application Priority Data

May 2, 2018 (CN) ..... 201810408070.9

(51) Int. Cl.
*G09G 3/36* (2006.01)

(52) U.S. Cl.
CPC ... *G09G 3/3611* (2013.01); *G09G 2300/0439* (2013.01); *G09G 2320/0233* (2013.01);
(Continued)

(58) Field of Classification Search
None
See application file for complete search history.

(56) References Cited

U.S. PATENT DOCUMENTS 9,536,498 B2 1/2017 Wu et al.
2003/0103046 A1* 6/2003 Rogers ..... G09G 3/34 345/204

(Continued)

FOREIGN PATENT DOCUMENTS

CN 104715731 A 6/2015

OTHER PUBLICATIONS

International Search Report in Application No. PCT/CN2019/070652, dated Mar. 27, 2019.

(Continued)

*Primary Examiner* — Chad M Dicke
(74) *Attorney, Agent, or Firm* — Syncoda LLC; Feng Ma

(57) ABSTRACT

A circuit and method facilitate driving a display panel to display an image with improved brightness uniformity are disclosed. In the circuit, an image information extraction sub-circuit extracts, and sends to a compensation processing sub-circuit, display information of each of the plurality of pixels based on the image. The compensation processing sub-circuit then divides a display region of the display panel into a plurality of sub-regions, obtains an average brightness value of each sub-region, and further determines whether a compensation is needed for displaying the image based on a uniformity of the average brightness values of all sub-regions. If so, the compensation processing sub-circuit further performs compensation to an input voltage and/or an effective light output area of each of the pixels to be lightened in each sub-region to thereby obtain an improved brightness uniformity when displaying the image.

19 Claims, 6 Drawing Sheets

(52) U.S. Cl.
CPC ..... *G09G 2320/0285* (2013.01); *G09G 2320/0686* (2013.01)

(56) References Cited

U.S. PATENT DOCUMENTS

2005/0231534 A1* 10/2005 Lee ..... G09G 3/2003 345/690
2013/0314641 A1* 11/2013 Okuda ..... G02F 1/1336 349/61
2014/0184671 A1* 7/2014 Lee ..... G09G 3/006 345/697
2016/0163271 A1* 6/2016 Sakaigawa ..... G02F 1/133615 345/694
2016/0203774 A1* 7/2016 Ahn ..... G09G 3/3426 345/102
2016/0335957 A1* 11/2016 Fu ..... G09G 3/36

OTHER PUBLICATIONS

CN First Office Action in Application No. 201810408070.9, dated Jun. 26, 2019.

* cited by examiner

CIRCUIT AND METHOD FOR ADJUSTING DISPLAY BRIGHTNESS LEVEL TO DISPLAY IMAGE WITH AN IMPROVED HOMOGENIZATION EFFECT

CROSS-REFERENCE TO RELATED APPLICATION

The present application claims priority to Chinese Patent Application No. 201810408070.9 filed on May 2, 2018, the disclosure of which is hereby incorporated by reference in its entirety.

TECHNICAL FIELD

The present disclosure relates generally to a field of display technologies, and more specifically to a circuit and method for adjusting the image display brightness level of a display panel, and a display apparatus containing the circuit and the display panel.

BACKGROUND

With the continuous development of display technologies, various new display technologies have emerged, among those technologies, transparent display technologies receive more and more attention because of their light transmittance characteristics.

In a transparent waveguide display panel, the liquid crystal cells therein are a waveguide transparent display layer, which works based on the status of the liquid crystal molecules stabilized by polymers, and lights from a light source enters the liquid crystal cells from the sides.

When displaying is not needed, the waveguide transparent display layer is in a transparent state that looks like glass. When displaying is needed, a voltage can be applied to a pre-set region of the above mentioned waveguide transparent display layer to thereby cause the liquid crystal molecules to deflect. With an influence by the polymer mixed with the liquid crystal molecules, the alignment of the liquid crystal molecules is chaotic and the light emitted is diffused, and as a result, the transparent waveguide display panel can realize a display.

SUMMARY

The present disclosure provides a circuit and method for adjusting the image display brightness level of a display panel, especially the transparent waveguide display panel, which can address the issues in the uniformity of the brightness level of an existing display technology.

In a first aspect, the present disclosure provides a circuit.

The circuit can be used for driving a display panel to display an image with an improved uniformity of brightness level. The display panel comprises a plurality of pixels. The circuit includes an image information extraction sub-circuit and a compensation processing sub-circuit.

The image information extraction sub-circuit is configured to extract display information corresponding to each of the plurality of pixels based on the image to be displayed, and then to send the display information to the compensation processing sub-circuit.

The compensation processing sub-circuit is configured to divide a display region of the display panel into a plurality of sub-regions; to obtain, based on the display information of each of the plurality of pixels, an average brightness value of each of the plurality of sub-regions to thereby obtain a group of average brightness values corresponding respectively to the plurality of sub-regions; to determine whether a compensation is needed for displaying the image based on a uniformity of the group of average brightness values; and if so, to compensate display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved.

According to some embodiments of the circuit, the compensation processing sub-circuit is further configured, before dividing a display region of the display panel into a plurality of sub-regions, to determine a number of the plurality of sub-regions based on a complexity of the image.

Herein, optionally, the number of the plurality of sub-regions can be 9, 16, or 25.

According to some embodiments of the circuit, the uniformity of the group of average brightness values is calculated by (Xmin/Xmax)*100%, where Xmin and Xmax respectively represents a minimum brightness value and a maximum brightness value among the group of average brightness values.

Optionally, the compensation processing sub-circuit is configured to determine that a compensation is needed for displaying the image if the uniformity of the group of average brightness values is smaller than 80%, or that a compensation is not needed if otherwise.

The circuit can further include a storage sub-circuit, which is communicatively coupled to the compensation processing sub-circuit and is configured to store a pre-stored average brightness value look-up table. As such, the compensation processing sub-circuit is configured to obtain the average brightness value of each of the plurality of sub-regions by calculating a ratio of pixels to be lightened in each of the plurality of sub-regions based on the display information of each of the plurality of pixels, and then by querying the ratio of pixels to be lightened in each of the plurality of sub-regions in the pre-stored average brightness value look-up table in the storage sub-circuit.

According to some embodiments, the pre-stored average brightness value look-up table comprises N sub-tables, each comprising a corresponding relationship between a different range of ratios of pixels to be lightened and an average brightness value, wherein N is an integer more than one.

Herein, according to one embodiment, N is equal to 11, and the N sub-tables in the pre-stored average brightness value look-up table comprises a gradient of 10% among one another, and correspond respectively a ratio of pixels to be lightened of 0%, 10%, 20%, 30%, 40%, 50%, 60%, 70%, 80%, 90%, and 100%.

Furthermore, the pre-stored average brightness value look-up table can optionally be obtained by measuring a monochrome image with a same gray scale.

In any of the embodiments of the circuit, the compensation processing sub-circuit is configured to compensate the display brightness levels of each of the pixels to be lightened in each of the plurality of sub-regions by compensating at least one of an effective light output area or an input voltage of each of the pixels to be lightened in each of the plurality of sub-regions.

According to some embodiments, the display information corresponding to each of the plurality of pixels comprises an input voltage for each of the plurality of pixels, and as such, the compensation processing sub-circuit is configured to compensate an input voltage of each of the pixels to be lightened in each of the plurality of sub-regions to thereby obtain a compensated input voltage for each of the plurality of pixels.

According to some other embodiments, each of the plurality of pixels in the display panel comprises a primary pixel and at least one compensating pixel, and as such, the compensation processing sub-circuit is configured to turn on or off one or more of the at least one compensating pixel to thereby compensate an effective light output area of each of the pixels to be lightened in each of the plurality of sub-regions.

Optionally, the circuit can further include a controlling sub-circuit, which is configured to receive the display information or the compensated display information corresponding to each of the plurality of pixels from the compensation processing sub-circuit, and to drive a display panel to display the image based on the display information or the compensated display information corresponding to each of the plurality of pixels.

In a second aspect, the present disclosure further provides a display apparatus.

The display apparatus includes a display panel, and the display panel includes a plurality of pixels in a display region thereof and further includes a circuit. Herein, the circuit can be based on any one of the embodiments of the circuit as described above.

According to some embodiments, the display apparatus further includes a side-in light source over one side of the display panel and configured to provide substantially parallel lights through the one side into the display panel. The plurality of sub-regions in the display panel are arranged in a matrix having rows and columns, wherein the rows are substantially in parallel to, and the columns are substantially perpendicular to, a direction of the lights transmitted in the display panel. As such, the compensation processing sub-circuit in the circuit of the display panel is configured to compensate an input voltage of each of the pixels to be lightened in each of the plurality of sub-regions of a same row based on a distance of the each of the pixels to the side-in light source.

Herein, the compensation processing sub-circuit in the circuit of the display panel can be configured to compensate an input voltage of each of the pixels to be lightened in each of the plurality of sub-regions of a same row by at least one of:

reducing an input voltage of a pixel to be lightened relatively close to the side-in light source; or increasing an input voltage of a pixel to be lightened relatively far away from the side-in light source.

According to some other embodiments, each of the plurality of pixels in the display panel comprises a primary pixel and at least one compensating pixel, and as such, the compensation processing sub-circuit in the circuit of the display panel is configured to turn on or off one or more of the at least one compensating pixel to thereby compensate an effective light output area of each of the pixels to be lightened in each of the plurality of sub-regions.

Herein, an area of each of the at least one compensating pixel can be around 20%-80% of an area of the primary pixel.

Herein, the display apparatus can include a side-in light source over one side of the display panel and configured to provide substantially parallel lights through the one side into the display panel, the plurality of sub-regions in the display panel can be arranged in a matrix having rows and columns, wherein the rows are substantially in parallel to, and the columns are substantially perpendicular to, a direction of the lights transmitted in the display panel.

As such, the compensation processing sub-circuit in the circuit of the display panel can be configured to compensate an effective light output area of each of the pixels to be lightened in each of the plurality of sub-regions of a same row based on a distance of the each of the pixels to the side-in light source.

Herein, optionally, each of the plurality of pixels comprises a primary pixel and a plurality of compensating pixels, each of the plurality of compensating pixels having a substantially equal size. As such, the compensation processing sub-circuit in the circuit of the display panel can be configured to compensate an effective light output area of each of the pixels to be lightened in each of the plurality of sub-regions by turning on an increased number of compensating pixels corresponding to a pixel to be lightened as a distance of the pixel to be lightened to the side-in light source increases.

Further optionally, each of the at least one compensating pixel corresponding to the primary pixel has an increased size as a distance of the each of the plurality of pixels to the side-in light source increases. As such, the compensation processing sub-circuit in the circuit of the display panel can be configured to compensate an effective light output area of each of the pixels to be lightened in each of the plurality of sub-regions by turning on the at least one compensating pixel in a pixel to be lightened.

In any one embodiment of the display apparatus as described above, the display panel can be a transparent waveguide display panel.

In a third aspect, the present disclosure further provides a method for adjusting display brightness level of a display panel comprising a plurality of pixels.

The method comprises the following steps:

extracting display information corresponding to each of the plurality of pixels from an image to be displayed in the display panel;

dividing a display region of the display panel into a plurality of sub-regions, wherein each of the plurality of sub-regions comprises at least one pixel;

obtaining an average brightness value of each of the plurality of sub-regions based on the display information of each of the plurality of pixels to thereby obtain a group of average brightness values corresponding respectively to the plurality of sub-regions;

determining whether a compensation is needed for displaying the image based on a uniformity of the group of average brightness values; and if so, compensating display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved.

According to some embodiments, between the step of extracting display information corresponding to each of the plurality of pixels from an image to be displayed in the display panel and the step of dividing a display region of the display panel into a plurality of sub-regions, wherein each of the plurality of sub-regions comprises at least one pixel, the method further comprises a step of:

determine a number of the plurality of sub-regions based on a complexity of the image.

According to some embodiments of the method, the number of the plurality of sub-regions is selected from 9, 16, or 25.

In the step of determining whether a compensation is needed for displaying the image based on a uniformity of the group of average brightness values, the uniformity of the group of average brightness values can optionally be calculated by (Xmin/Xmax)*100%, where Xmin and Xmax represents a minimum brightness value and a maximum brightness value among the group of average brightness values, respectively. Further optionally, the compensation can optionally be determined to be needed if the uniformity of the group of average brightness values is smaller than 80%, or that the compensation is not needed if otherwise.

According to some embodiments of the method, the step of obtaining an average brightness value of each of the plurality of sub-regions based on the display information of each of the plurality of pixels comprises the following sub-steps:

calculating a ratio of pixels to be lightened in each of the plurality of sub-regions based on the display information of each of the plurality of pixels; and querying the ratio of pixels to be lightened in each of the plurality of sub-regions in a pre-stored average brightness value look-up table in the storage sub-circuit.

Herein, optionally, the pre-stored average brightness value look-up table can comprise N sub-tables, and each of the N sub-tables comprises a corresponding relationship between a different range of ratios of pixels to be lightened and an average brightness value. Herein, N is an integer more than one.

According to some embodiments, N is equal to 11, and the N sub-tables in the pre-stored average brightness value look-up table comprises a gradient of 10% among one another, and correspond respectively a ratio of pixels to be lightened of 0%, 10%, 20%, 30%, 40%, 50%, 60%, 70%, 80%, 90%, and 100%.

Prior to the step of obtaining an average brightness value of each of the plurality of sub-regions based on the display information of each of the plurality of pixels, the method can further include a step of:

obtaining the pre-stored average brightness value look-up table by measuring a monochrome image with a same gray scale.

In any one of the embodiments of the method described above, the step of compensating display brightness levels of each of the pixels to be lightened in each of the plurality of sub-regions can be realized by compensating at least one of an effective light output area or an input voltage of each of the pixels to be lightened in each of the plurality of sub-regions.

According to some embodiments, in the step of extracting display information corresponding to each of the plurality of pixels from an image to be displayed in the display panel, the display information corresponding to each of the plurality of pixels comprises an input voltage for each of the plurality of pixels. As such, the step fo compensating display brightness levels of each of the pixels to be lightened in each of the plurality of sub-regions comprises:

compensating an input voltage of each of the pixels to be lightened in each of the plurality of sub-regions to thereby obtain a compensated input voltage for each of the plurality of pixels.

According to some other embodiments, each of the plurality of pixels in the display panel comprises a primary pixel and at least one compensating pixel. As such, the step of compensating display brightness levels of each of the pixels to be lightened in each of the plurality of sub-regions comprises:

turning on or off one or more of the at least one compensating pixel to thereby compensate an effective light output area of each of the pixels to be lightened in each of the plurality of sub-regions.

BRIEF DESCRIPTION OF DRAWINGS

To more clearly illustrate some of the embodiments, the following is a brief description of the drawings. The drawings in the following descriptions are only illustrative of some embodiments. For those of ordinary skill in the art, other drawings of other embodiments can become apparent based on these drawings.

DETAILED DESCRIPTION

In the following, with reference to the drawings of the embodiments disclosed herein, the technical solutions of the embodiments of the invention will be described in a clear and fully understandable way. It is noted that the described embodiments are merely a portion but not all of the embodiments of the invention. Based on the described embodiments of the invention, those ordinarily skilled in the art can obtain other embodiment(s), which come(s) within the scope sought for protection by the invention.

Inventors of the invention disclosed herein in the present disclosure have realized that current transparent display technologies have an issue of sub-ideal uniformity of the brightness level of the display panel. This issue is primarily caused by the fact the light source of the transparent waveguide display panel is arranged at a side of the transparent waveguide display panel. As such, when the light source emits light from the side of the liquid crystal layer in the waveguide transparent display layer, the brightness level of a display region will be influenced depending on the distance of the display region from the light source.

Figure 1:
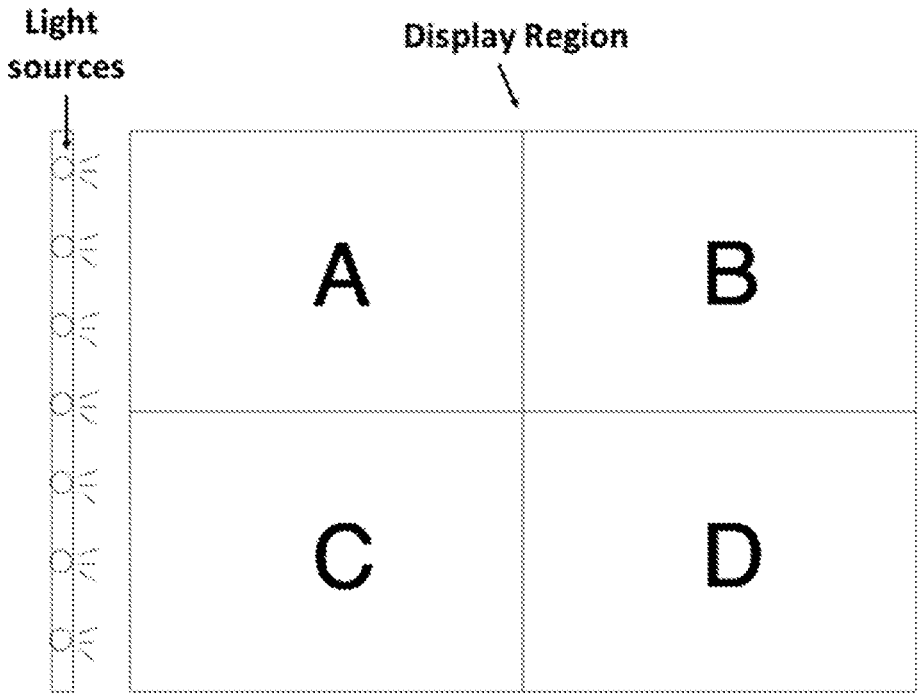
FIG. 1 (prior art)
FIG. 1 is a structural diagram of a transparent waveguide display panel according to existing technologies.

Specifically, as illustrated in FIG. 1, the display region of the transparent waveguide display panel includes four display sub-regions (i.e. A, B, C and D), and light sources that are configured to provide lights to the transparent waveguide display panel are arranged at one side (i.e. left side) of the transparent waveguide display panel. The sub-region A and the sub-region C are relatively closer to the light source, whereas the sub-region B and the sub-region D are relatively farther from the light source.

As such, in situations where the sub-region A does not emit lights while each of the sub-region B, the sub-region C and the sub-region D emits lights, because the sub-region A does not emit lights, the brightness level of sub-region B and sub-region C are similar to each other, whereas the brightness level of the sub-region D is lower than sub-region B. As a result, the uniformity of the brightness level of the display panel is sub-ideal under these situations.

In order to address the above issue of sub-ideal brightness uniformness in the display region of the transparent waveguide display panel, the present disclosure provides the following solutions.

In a first aspect, an image brightness adjustment method for a display panel is provided.

Figure 2:
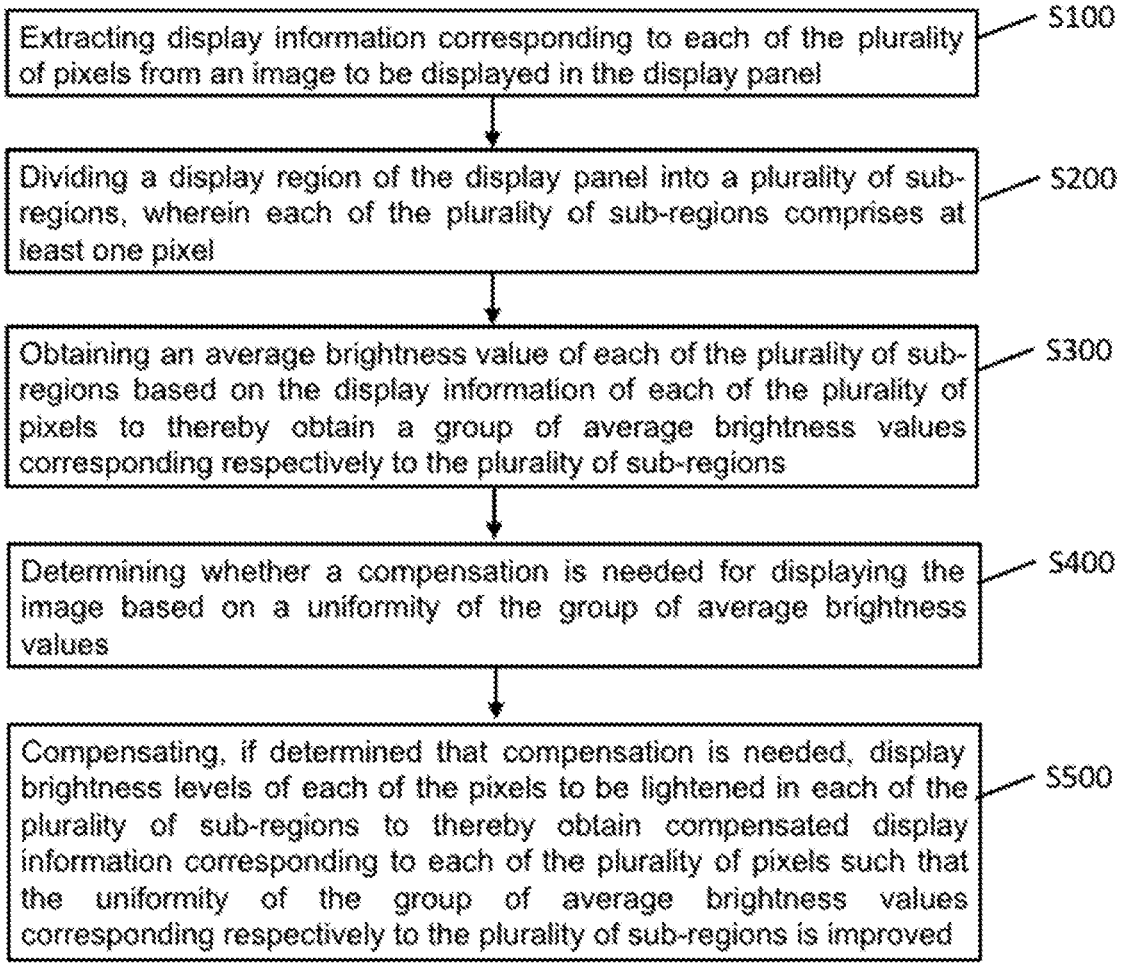
FIG. 2 is a flow chart of an image brightness adjustment method for a display panel provided by some embodiments of the present disclosure.

FIG. 2 shows a flow chart of a display panel image brightness adjustment method provided by some embodiments of the present disclosure. The method can be utilized for adjusting the display brightness level of a display panel that comprises a plurality of pixels in its display area, and it is configured to improve the uniformity or evenness of the brightness levels when the display panel displays the image.

Herein, the display panel can be a transparent waveguide display panel, which can be made of liquid crystal molecules stabilized by polymers. In the transparent waveguide display panel, the transparent display region contains a waveguide transparent display layer comprising liquid crystal molecules which are stabilized by polymers, and the light sources of the display panel can be located at a side of the waveguide transparent display layer. Depending on the different designs, models, and sizes of the display panels, the light sources can be located at a same side of the waveguide transparent display layer, or the light sources can be located at two sides of the waveguide transparent display layer.

It is noted that for illustrating purposes only, the image brightness adjustment method is described below with the display panel having its light sources arranged at only one side, for example, at a left side as illustrated in any one of FIGS. 5-8, of a display region of the display panel. Accordingly, the vertical direction is defined as a direction parallel to an extension direction of the light sources (i.e. the top-to-bottom direction on a top view of the display panel as illustrated in any of FIGS. 5-8), and the horizontal direction is defined as a direction perpendicular to the extension direction of the light sources (i.e. the left-to-right direction on the top view of the display panel as illustrated in any of FIGS. 5-8).

Herein, the method illustrated in FIG. 2 can be performed through a specialized circuit in the display panel that can realize an improved uniformity/evenness for the display panel to display images dynamically, which will be described in greater detail in the second aspect of the disclosure.

As illustrated in FIG. 2, the image brightness adjustment method comprises the following steps:

S100: Extracting display information corresponding to each of the plurality of pixels from an image to be displayed in the display panel.

Herein specifically in this step, based on the image to be displayed in the display panel, the display information corresponding to each of the plurality of pixels can be first extracted.

S200: Dividing a display region of the display panel into a plurality of sub-regions (e.g. M sub-regions, where M is an integer equal or larger than 2), wherein each of the plurality of sub-regions comprises at least one pixel, and a display state of each of the at least one pixel comprises a lightened state and a non-lightened state.

Specifically, it can be configured such that at least two sub-regions among the M sub-regions have different distances to the light sources of the display panel. For example, the M sub-regions can be arranged along a vertical and a horizontal direction.

Herein, for display panels whose display regions are transparent, when a pixel is in a lightened state, this pixel displays as one pixel, whereas when the pixel is in a non-lightened state, this pixel is transparent.

According to some embodiments of the disclosure, the total number of the plurality of sub-regions (i.e. the value of M) can be pre-determined and fixed for each image to be displayed, which can be, for example, 9, 16, or 25. It is noted that these numbers are just illustrating examples, and do not impose a limitation to the scope of the disclosure.

According to some other embodiments of the disclosure, the total number of the plurality of sub-regions (i.e. the value of M) can be dynamically adjusted, based on the actual feature of the image to be displayed. As such, prior to step S200, the method further comprises a step of:

Determining a number of the plurality of sub-regions (i.e. the value of M) based on the image to be displayed.

Herein, optionally, the number of the plurality of sub-regions can be determined based on a complexity of the image. If the picture information in the image to be displayed is relatively simple, the value of M can be relatively small. If the information of the image to be displayed is relatively complicated, the value of M can be relatively large.

S300: Obtaining an average brightness value of each of the plurality of sub-regions based on the display information of each of the plurality of pixels to thereby obtain a group of average brightness values corresponding respectively to the plurality of sub-regions.

In this step S300, based on the display information of each of the plurality of pixels that is obtained from the step S100, an average brightness value of each of the plurality of sub-regions can be obtained.

For example, through analysis of the display information corresponding to each of the plurality of pixels, a ratio of pixels to be lightened in the image in each of the plurality of sub-regions can be obtained. Then by querying the ratio of pixels to be lightened in each of the plurality of sub-regions in a pre-stored average brightness value look-up table, the average brightness value of each of the plurality of sub-regions can be obtained.

Herein, the pre-stored average brightness value look-up table can be obtained by measuring a monochrome image with a same gray scale in advance. Yet optionally it can also be obtained from somewhere else, such as one downloaded from the Internet (e.g. from the manufacturer), or can be established according to some embodiments of the method.

According to some embodiments, the pre-stored average brightness value look-up table comprises N sub-tables. Each of the N sub-tables comprises a corresponding relationship between a different range of ratios of pixels to be lightened and an average brightness value, wherein N is an integer more than one.

In one specific example, N is equal to 11, and the N sub-tables in the pre-stored average brightness value look-up table comprises a gradient of 10% among one another, and correspond respectively a ratio of pixels to be lightened of 0%, 10%, 20%, 30%, 40%, 50%, 60%, 70%, 80%, 90%, and 100%. It is noted that the N can be a different number according to some other embodiments of the disclosure.

S400: Determining whether a compensation is needed for displaying the image based on a uniformity of the group of average brightness values.

After obtaining an average brightness value of each of the plurality of sub-regions in step S300, a determination will be made in step S400 whether a compensation is needed for displaying the image based on a uniformity of the group of average brightness values.

According to some embodiments, the uniformity of the group of average brightness values can be calculated by the following formula:

$$\text{uniformity}=(X\text{min}/X\text{max})*100\%;$$

where Xmin and Xmax respectively represents a minimum brightness value and a maximum brightness value among the group of average brightness values.

Herein, whether or not a compensation is needed for displaying the image is based on whether the uniformity of the group of average brightness values is smaller than a pre-determined threshold. If the uniformity calculated is smaller than the pre-determined threshold, a compensation is needed, otherwise a compensation is not needed.

The pre-determined threshold can be set based on practical needs. According to some embodiments, such as for a high-end display panel which requires a relatively high uniformity when displaying, a relative high threshold, such as 80%, can be applied as the pre-determined threshold. Yet the pre-determined threshold can have a different number.

S500: Compensating, if determined that a compensation is needed, display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved.

Herein the step S500 is substantially a homogenization step allowing the brightness level of the image to be displayed across different sub-regions of the M sub-regions to become relatively more uniform.

According to different embodiments of the disclosure, the compensation can be performed by at least one of the following two measures:

(A) compensating an input voltage of each lightened pixels (i.e. pixels to be lightened) in the at least one sub-region; and/or (B) compensating an effective light output area of each lightened pixels in the at least one sub-region.

For each lightened pixel, the higher the corresponding input voltage, the higher the display brightness level. On the other hand, the lower the input voltage, the lower the display brightness level. For each lightened pixel, the larger its effective light output area, the higher the level of display brightness. On the other hand, the smaller its light output area, the lower the level of display brightness. The compensation can be performed to adjust the input voltage/effective light output area of each pixel to be lightened corresponding to each sub-region with a mean value of the average brightness values of all of the M sub-regions as a standard.

The following three brightness level compensation measures, according to three different embodiments of the method, can be utilized to compensate the display brightness levels of each pixel to be lightened in each of the M sub-regions.

In a first brightness level compensation measure, the compensation step in S500 is realized by only adjusting an input voltage of each lightened pixels. As such, the display information of each of the plurality of pixels include an input voltage of each of the plurality of pixels, and the step S500 comprises:

S500A: Compensating an input voltage of each of the pixels to be lightened in each of the plurality of sub-regions to thereby obtain a compensated input voltage for each of the plurality of pixels.

Optionally, in the step S500A, the compensation of the input voltage of each of the pixels to be lightened can be based on a pre-determined voltage-brightness curve of pixels of the display panel. Herein, the voltage-brightness curve of pixels of the display panel is a physic characteristics curve of the pixels of the display panel, which can be obtained through inquiry about the physic characteristics of the display panel, or through testing.

As such, the compensated display information corresponding to each of the plurality of pixels can be the compensated input voltage, calculated by the following formula:

$$\text{Compensated input voltage}=\text{original input voltage}+\text{compensation value};$$

The compensation in step S500A can be realized, for example, by reducing the input voltage (i.e. compensation value is negative) in the pixels to be lightened in sub-regions that are relatively closer to the light source, and/or by increasing the input voltage (i.e. compensation value is positive) in the pixels to be lightened in sub-regions that are relatively farther away from the light source.

In a second brightness level compensation measure, the compensation step in S500 is realized by only adjusting an effective light output area of each lightened pixels.

According to some embodiments, each of the plurality of pixels in the display panel comprises a primary pixel and at least one compensating pixel, and the at least one compensating pixel is configured to be able to controllably adjust an effective light output area thereof. In other words, in each lightened pixel, an effective light output area of the primary pixel is not adjustable, whereas the effective light output area of the at least one compensating pixel is adjustable, and a sum of the effective light output area of the primary pixel and the effective light output area of the at least one compensating pixel determines a display brightness level of the each lightened pixel. As such, the display brightness level of a lightened pixel can be adjusted through adjusting an effective light output area of the at least one compensating pixel in the lightened pixel.

As such, the step S500 can thus comprises:

S500B: turning on or off one or more of the at least one compensating pixel to thereby compensate an effective light output area of each of the pixels to be lightened in each of the plurality of sub-regions.

Herein, the various arrangements and configurations for the primary pixel and at least one compensating pixel will be described in detail in the following and illustrated in FIGS. 5-8.

Figure 5:
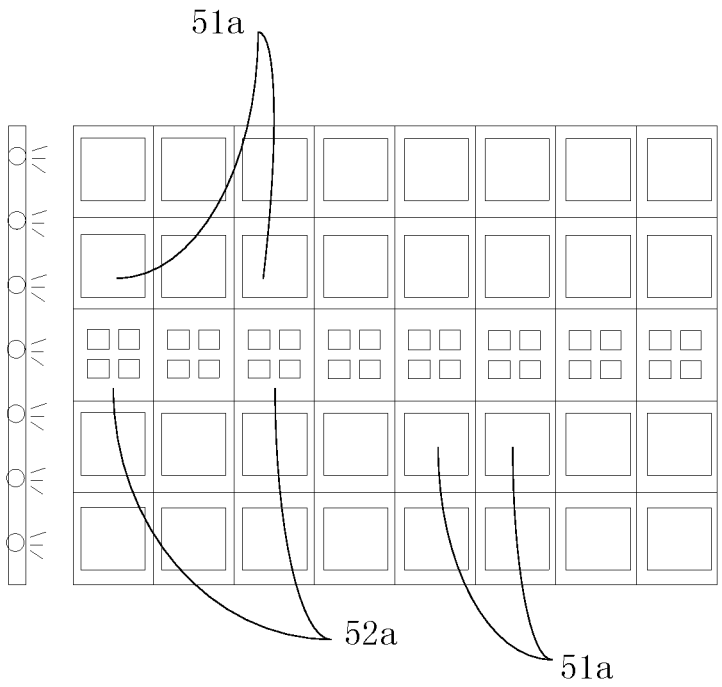
FIG. 5 is a structural diagram illustrating an arrangement of pixels comprising compensating pixels according to one embodiment of the present disclosure.
Figure 6:
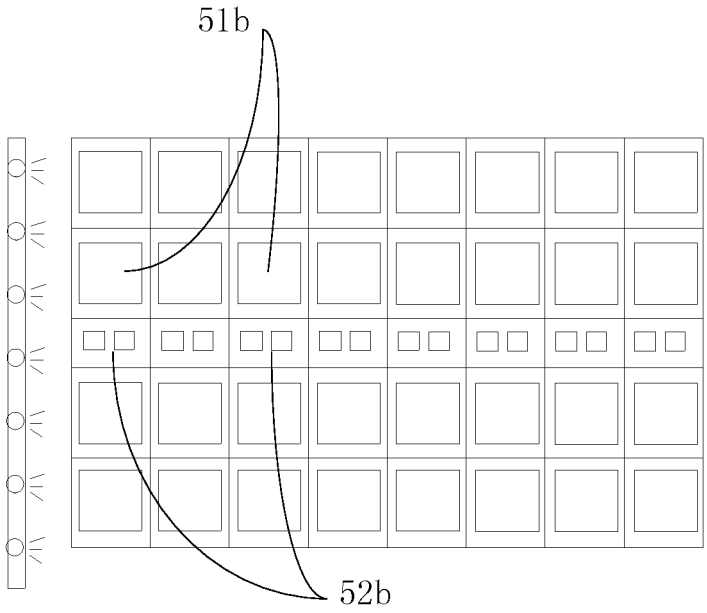
FIG. 6 is a structural diagram illustrating an arrangement of pixels comprising compensating pixels according to another embodiment of the present disclosure.

According to some embodiments, each pixel comprises a primary pixel and a plurality of compensating pixels, and each of the plurality of compensating pixels having a substantially equal size, as illustrated in FIG. 5 or FIG. 6 described below. As such, the effective light output area of each of the pixels to be lightened in each of the plurality of sub-regions can be compensated by turning on an increased number of compensating pixels corresponding to a pixel to be lightened as a distance of the pixel to be lightened to the side-in light source increases.

Figure 7:
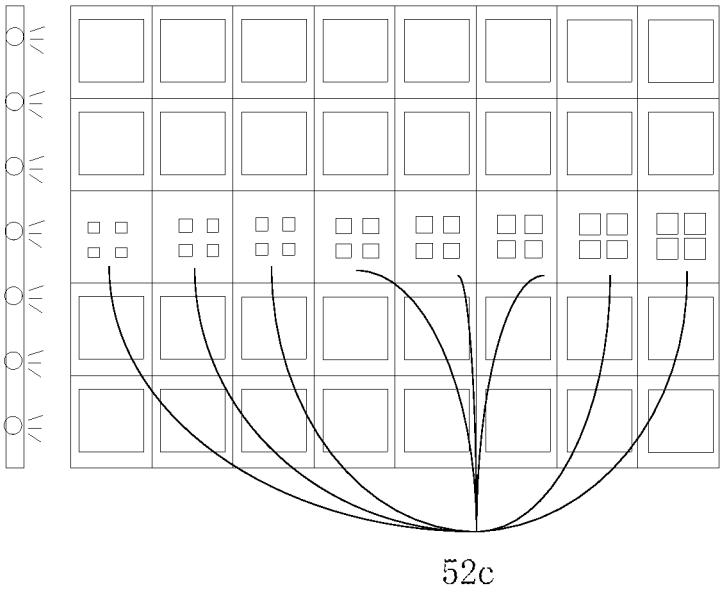
FIG. 7 is a structural diagram illustrating an arrangement of pixels comprising compensating pixels according to yet another embodiment of the present disclosure.

According to some other embodiments, each of the at least one compensating pixel corresponding to the primary pixel has an increased size as a distance of the each of the plurality of pixels to the side-in light source increases, as illustrated in FIG. 7. As such, the effective light output area of each of the pixels to be lightened in each of the plurality of sub-regions can be compensated by turning on the at least one compensating pixel in a pixel to be lightened.

It is noted that according to some other embodiments, the lightened pixels can be pixels whose effective light output area can be adjusted, and therefore, the brightness level compensation is achieved through directly adjusting the pixels which the effective light output area can be adjusted.

The inventors of the invention disclosed herein have discovered that in practice, the pixels of the display panel has limited brightness display capability, that is, the value of the input voltage of the pixel is limited. In other words, if the input voltage is too high, the display panel can easily get burned.

Thus in order to avoid the above issue, a third brightness level compensation measure is also provided, which substantially involves compensation by means of adjusting both an effective light output area and an input voltage of the lightened pixels in the image to be displayed, can be applied.

This third brightness level compensation measure substantially comprises the following sub-steps:

S510C: performing a first compensation sub-step; and

S520C: Determining if a pre-set condition is triggered, and if so, performing a second compensation sub-step.

In sub-step S510C, the first compensation sub-step can be performed to try to adjust the input voltage of the lightened pixels, such that the input voltage in first set of pixels to be lightened in sub-regions that are relatively closer to the light source is reduced, whereas the input voltage in second set of pixels to be lightened in sub-regions that are relatively farther away from the light source is increased. Herein, this first compensation sub-step can reference to the first brightness level compensation measure described above.

In sub-step S520C: if it is determined that a pre-set condition is triggered, such as an increase of the input voltage of any of the second set of pixels is beyond the display capability, a second compensation sub-step can be further triggered to adjust the effective light output area of the second set of pixels, which can be realized by turning on one or more of the at least one compensating pixel to thereby compensate an effective light output area of each of the second set of pixels to be lightened.

Herein, the standard for evaluating whether an increase of the input voltage of any of the second set of pixels is beyond the display capability can be based on a maximum working voltage of the pixels. If the increase of the input voltage can cause the voltage to be larger than the maximum working voltage of the pixels, for example, it is determined that the second compensation sub-step by compensating the effective light output area of the pixels is needed.

In summary, by means of the above brightness level compensation method, the display information corresponding to each pixel from an image to be displayed in the display panel is first extracted, then based on the display information, the display area of the display panel can be divided into a total of M sub-regions. Further an average brightness value of each of the M sub-regions can be obtained based on the display information of each pixel (to be lightened or not) by, for example, querying the ratio of pixels to be lightened in each sub-region in a pre-stored average brightness value look-up table.

Then a determination is made regarding whether a compensation is needed for displaying the image based on a uniformity of the group of average brightness values. If so, the brightness level of the at least one sub-region can be compensated (i.e. homogenized) by adjusting the input voltage or the effective light output area of each pixels to be lightened in each of the M sub-regions. As such, the brightness level of the image to be displayed can become relatively more uniform.

It is noted that in the aforementioned display brightness level adjustment method of the display panel, the image to be displayed can be just one still image, or can optionally be one frame of image in a video. In displaying a video, the display image brightness level adjustment method of the display panel can be applied to each frame of image in the video, thus a uniform brightness level when displaying the video can be achieved. Generally, in each frame of image to be displayed in displaying a video, not all images to be displayed need to have their brightness level adjusted.

In a second aspect, the present disclosure further provides a circuit for realizing the above mentioned image brightness adjustment method.

The circuit can be part of a driving circuit for the display panel, and can be used to execute an image brightness adjustment method to thereby allow a homogenization of brightness of the display panel, which can be termed a brightness homogenization circuit hereafter. The image brightness adjustment method can be based on any one of the embodiments as described above.

Figure 3:
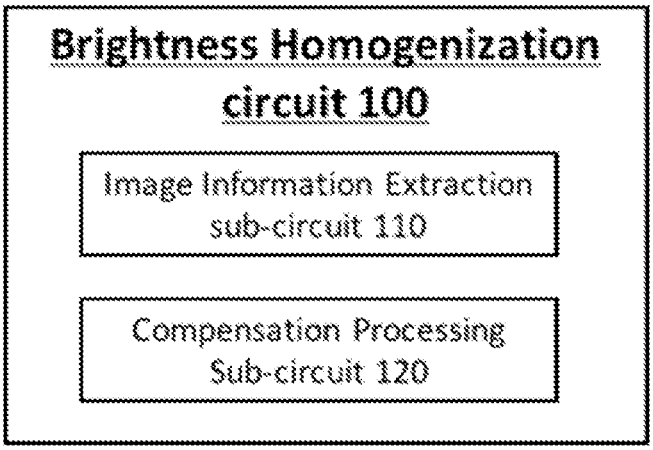
FIG. 3 is a block diagram of a brightness homogenization circuit realizing the image brightness adjustment method shown in FIG. 2 according to some embodiments of the present disclosure.

FIG. 3 illustrates a brightness homogenization circuit according to some embodiments of the present disclosure. As shown in FIG. 3, the brightness homogenization circuit 100 includes an image information extraction sub-circuit 110 and a compensation processing sub-circuit 120.

The image information extraction sub-circuit 110 is configured to extract display information corresponding to each of the plurality of pixels based on the image, and then to send the display information corresponding to each of the plurality of pixels to the compensation processing sub-circuit 120.

The compensation processing sub-circuit 120 is configured to divide a display region of the display panel into a plurality of sub-regions, to obtain, based on the display information of each of the plurality of pixels, an average brightness value of each of the plurality of sub-regions to thereby obtain a group of average brightness values corresponding respectively to the plurality of sub-regions, to determine whether a compensation is needed for displaying the image based on a uniformity of the group of average brightness values, and if so, to compensate display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved.

As such, the brightness homogenization circuit 100 is substantially designed to specifically perform the image brightness adjustment method for a display panel as described in the first aspect, with the image information extraction sub-circuit 110 configured specifically to carry out the step S100, and with the compensation processing sub-circuit 120 configured specifically to carry out the steps S200, S300, S400, and S500 sequentially.

Figure 4:
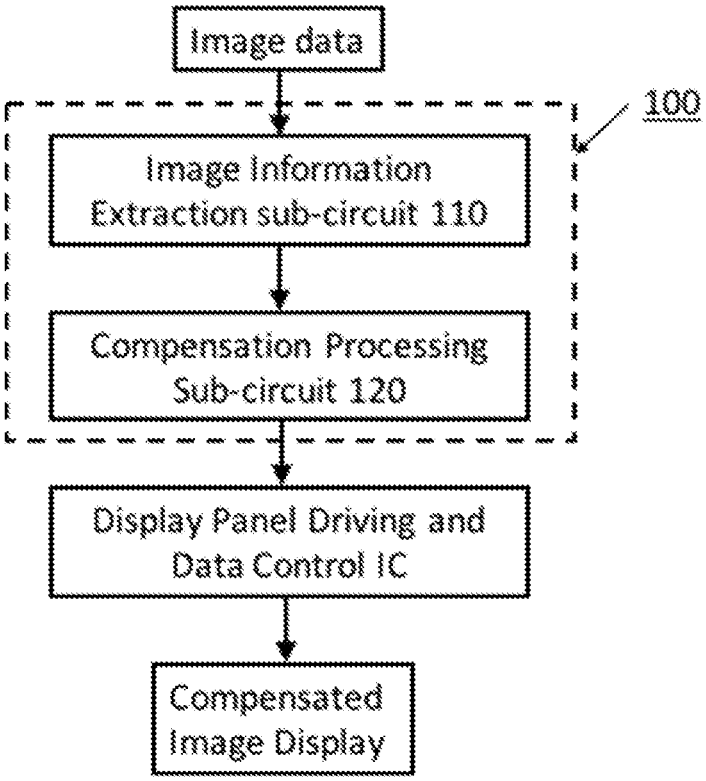
FIG. 4 is a schematic diagram of the working process of the brightness homogenization circuit shown in FIG. 3 in the whole process of displaying an image by the display panel according to some embodiments of the present disclosure.

FIG. 4 is a schematic diagram of the working process of the brightness homogenization circuit in the whole working process of displaying an image by the display panel.

As shown in FIG. 4, the image information extraction sub-circuit 110 of the brightness homogenization circuit 100 is configured to input image data from the system, and then after extracting the display information corresponding to each pixel of the display panel (i.e. step S100), to further send the display information to the compensation processing sub-circuit 120.

The compensation processing sub-circuit 120 of the brightness homogenization circuit 100 then performs the steps S200-S500, and then sends the compensated display information corresponding to each pixel of the display panel downstream to a driving and data control sub-circuit (shown as "Display Panel Driving and Data Control IC"), which further control the display panel to display the image that has been compensated.

In a third aspect, the present disclosure further provides a display apparatus. The display apparatus includes a display panel, and the display panel includes a plurality of pixels in a display region thereof and further includes a brightness homogenization circuit. Herein, the brightness homogenization circuit can be based on any one of the embodiments of the circuit as described above.

According to some embodiments, the display apparatus can be a transparent waveguide display panel, and further includes a side-in light source over one side of the display panel, which is configured to provide substantially parallel lights through the one side into the display panel.

The plurality of sub-regions in the display panel are arranged in a matrix having rows and columns, wherein the rows are substantially in parallel to, and the columns are substantially perpendicular to, a direction of the lights transmitted in the display panel.

According to some embodiments, the compensation processing sub-circuit in the brightness homogenization circuit of the display panel is configured to compensate an input voltage of each of the pixels to be lightened in each of the plurality of sub-regions of a same row based on a distance of the each of the pixels to the side-in light source.

As such, the compensation processing sub-circuit can be configured to compensate an input voltage of each of the pixels to be lightened in each of the plurality of sub-regions of a same row by at least one of:

reducing an input voltage of a pixel to be lightened relatively close to the side-in light source; or increasing an input voltage of a pixel to be lightened relatively far away from the side-in light source.

According to some other embodiments, each of the plurality of pixels in the display panel comprises a primary pixel and at least one compensating pixel, and as such, the compensation processing sub-circuit in the circuit of the display panel is configured to turn on or off one or more of the at least one compensating pixel to thereby compensate an effective light output area of each of the pixels to be lightened in each of the plurality of sub-regions.

As such, the compensation processing sub-circuit in the brightness homogenization circuit of the display panel can be configured to compensate an effective light output area of each of the pixels to be lightened in each of the plurality of sub-regions of a same row based on a distance of the each of the pixels to the side-in light source.

Optionally, each of the plurality of pixels comprises a primary pixel and a plurality of compensating pixels, each of the plurality of compensating pixels having a substantially equal size. As such, the compensation processing sub-circuit in the circuit of the display panel can be configured to compensate an effective light output area of each of the pixels to be lightened in each of the plurality of sub-regions by turning on an increased number of compensating pixels corresponding to a pixel to be lightened as a distance of the pixel to be lightened to the side-in light source increases.

Further optionally, each of the at least one compensating pixel corresponding to the primary pixel has an increased size as a distance of the each of the plurality of pixels to the side-in light source increases. As such, the compensation processing sub-circuit in the circuit of the display panel can be configured to compensate an effective light output area of each of the pixels to be lightened in each of the plurality of sub-regions by turning on the at least one compensating pixel in a pixel to be lightened.

The following provides a detailed description of how the at least one compensating pixel is arranged relative to the primary pixel and how the compensation can be realized.

According to some embodiments, each of the at least one compensating pixel is turned off, and the initial effective light output area of the at least one compensating pixel is zero. By increasing the number of the compensating pixels, the effective light output area of the pixel can only be increased, and the display brightness level of the lightened pixels can be improved.

In some other embodiments, some light-emitting points are turned on, some light-emitting points are turned off, and thus the initial light output areas of the compensating pixel are larger than zero. Thus by adjusting the number of compensating pixels that are turned on, the effective light output area can be adjusted. For example, the number of the compensating pixels that are turned on can be increased to thereby increase the display brightness level of the pixels is increased; the number of compensating pixels that are turned on can be reduced to thereby decrease the display brightness level of the pixels.

According to some embodiments as illustrated in FIG. 5, the lightened pixels 51*a* and the compensating pixels 52*a* are both plural in their respective numbers. The plurality of lightened pixels 51*a* and the plurality of compensating pixels 52*a* are arranged in different rows: the compensating pixels 52*a* in each row can compensate the brightness level of the lightened pixels 51*a* of a neighboring row. As further shown in FIG. 5, a width occupied by the plurality of lightened pixels 51*a* in each row and a width occupied by the plurality of compensating pixels 51*a* in each row are substantially the same. Specifically, four compensating pixels 52*a* together forming two sub-rows in a row correspond to one lightened pixels 51*a*.

In some other embodiments, the width occupied by the plurality of lightened pixels of each row and the width occupied by the plurality of compensating pixels of each column can also be different. As shown in FIG. 6, the width occupied by the plurality of lightened pixels 51*b* of each row is larger than the width occupied by the plurality of compensating pixels 51*a* of each row. In other words, two compensating pixels 52*b* together forming a single row correspond to one lightened pixels 51*b*.

In both the embodiments illustrated in FIG. 5 and FIG. 6, the effective light output area of each of the plurality of compensating pixels in each row is substantially same. According to some other embodiments, for example, as shown in FIG. 7, the effective light output areas of the plurality of compensating pixels 52*c* of each column can be configured to increase as its distance from the light sources of the display panel increase, as such the largest effective light output area of the compensating pixels increase gradually.

Figure 8:
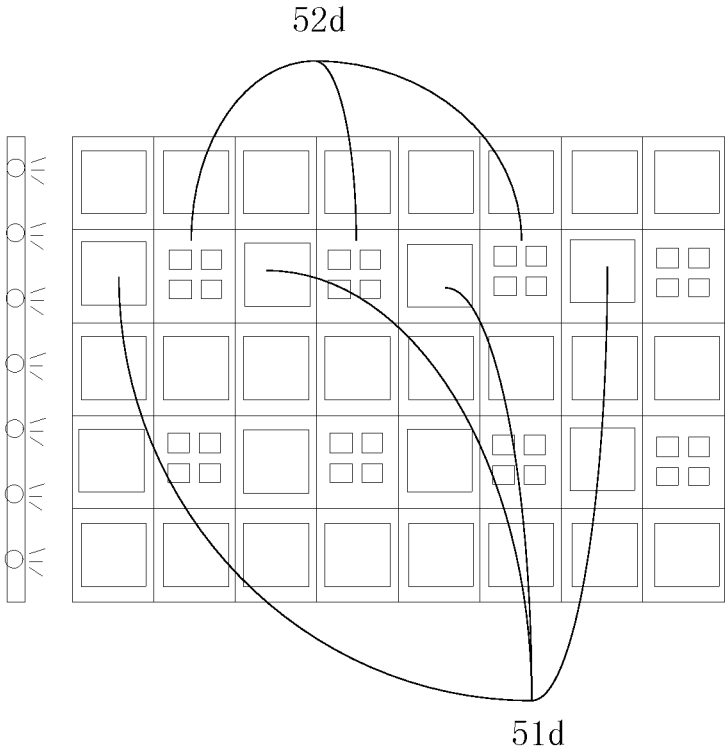
FIG. 8 is a structural diagram illustrating an arrangement of pixels comprising compensating pixels according to still yet another embodiment of the present disclosure.

According to some embodiments shown in FIG. 8, the lightened pixels and the compensating pixels are both plural in their respective numbers. The plurality of lightened pixels 51*d* and the plurality of compensating pixels 52*d* are arranged alternately in a same row. The compensating pixels can be shared by their surrounding lightened pixels for the purposes of brightness level compensation.

It is noted that the lightened pixels and the compensating pixels may be of any shape, such as square, hexagon, pentagon, diamond, triangle and so on. The area of each of the compensating pixels can be around 0.2-0.8 (i.e. 20%-80%) of the area of each of the lightened pixels.

In a third aspect, a display apparatus capable of adjusting an image brightness thereof is further disclosed.

The display apparatus comprises a display panel and an image brightness adjustment device according to any one of the embodiments described above. Herein, the display panel can be a transparent waveguide display panel.

The display apparatus may be any products or components with display functions such as display panels, electronic papers, mobile phones, laptops, televisions, monitors, digital photo frames, or navigators.

The display panel is configured to have a transparent display region. The transparent display region has a waveguide transparent display layer comprising liquid crystal molecules stabilized by polymers, and the light sources of the display panel is located at a side of the wave-guide transparent display layer.

For display panels of different types, the light sources may be located at a same side of the waveguide transparent display layer, or may be located at the different sides of the waveguide transparent display layer, and so on. The pixels of the transparent display region are distributed at the waveguide transparent layer.

The display apparatus can ensure that the brightness of the image to be displayed is substantially uniform when the image is displayed.

It should be noted that in the above, although the description of the display apparatus is provided to an example with a transparent waveguide display panel having one side-in light source, this example serves only as illustrating purpose only, and there is no limitation to the type of the display panel, and the brightness homogenization circuit can be used for any type of display panel for the homogenization of brightness of each image to be displayed in the display panel. In addition, there is no limitation to the number of side-in light source in the display panel, for example, there can be two side-in light sources, arranged over two opposing sides of the display panel.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation to encompass such modifications and equivalent structures.

The invention claimed is:

1. A circuit for driving a display panel to display an image with an improved homogenization effect, wherein the display panel comprises a plurality of pixels, the circuit comprising an image information extraction sub-circuit and a compensation processing sub-circuit, wherein:

the image information extraction sub-circuit is configured to extract, and to send to the compensation processing sub-circuit, display information corresponding to each of the plurality of pixels based on the image; and the compensation processing sub-circuit is configured:

to divide a display region of the display panel into a plurality of sub-regions;

to obtain, based on the display information of each of the plurality of pixels, an average brightness value of each of the plurality of sub-regions to thereby obtain a group of average brightness values corresponding respectively to the plurality of sub-regions;

to determine whether a compensation is needed for displaying the image based on a uniformity of the group of average brightness values; and if so, to compensate display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved;

the circuit further comprising a storage sub-circuit, communicatively coupled to the compensation processing sub-circuit and configured to store a pre-stored average brightness value look-up table, wherein:

the compensation processing sub-circuit is configured to obtain the average brightness value of each of the plurality of sub-regions:

by calculating a ratio of pixels to be lightened in each of the plurality of sub-regions based on the display information of each of the plurality of pixels; and then by querying the ratio of pixels to be lightened in each of the plurality of sub-regions in the pre-stored average brightness value look-up table in the storage sub-circuit.

2. The circuit of claim 1, wherein the compensation processing sub-circuit is further configured, before dividing a display region of the display panel into a plurality of sub-regions, to determine a number of the plurality of sub-regions.

3. The circuit of claim 1, wherein the uniformity of the group of average brightness values is calculated by (Xmin/Xmax)*100%, where Xmin and Xmax respectively represents a minimum brightness value and a maximum brightness value among the group of average brightness values.

4. The circuit of claim 3, wherein the compensation processing sub-circuit is configured to determine that a compensation is needed for displaying the image if the uniformity of the group of average brightness values is smaller than 80%, or that a compensation is not needed if otherwise.

5. The circuit of claim 1, wherein the pre-stored average brightness value look-up table comprises N sub-tables, each comprising a corresponding relationship between a different range of ratios of pixels to be lightened and an average brightness value, wherein N is an integer more than one.

6. The circuit of claim 5, wherein N is equal to 11, and the N sub-tables in the pre-stored average brightness value look-up table comprises a gradient of 10% among one another, and correspond respectively a ratio of pixels to be lightened of 0%, 10%, 20%, 30%, 40%, 50%, 60%, 70%, 80%, 90%, and 100%.

7. The circuit of claim 1, wherein the pre-stored average brightness value look-up table is obtained by measuring a monochrome image with a same gray scale.

8. The circuit of claim 1, wherein the compensation processing sub-circuit is configured to compensate the display brightness levels of each of the pixels to be lightened in each of the plurality of sub-regions by compensating at least one of an effective light output area or an input voltage of each of the pixels to be lightened in each of the plurality of sub-regions.

9. The circuit of claim 8, wherein the display information corresponding to each of the plurality of pixels comprises an input voltage for each of the plurality of pixels, wherein:

the compensation processing sub-circuit is configured to compensate an input voltage of each of the pixels to be lightened in each of the plurality of sub-regions to thereby obtain a compensated input voltage for each of the plurality of pixels.

10. The circuit of claim 8, wherein each of the plurality of pixels in the display panel comprises a primary pixel and at least one compensating pixel, wherein:

the compensation processing sub-circuit is configured to turn on or off one or more of the at least one compensating pixel to thereby compensate an effective light output area of each of the pixels to be lightened in each of the plurality of sub-regions.

11. The circuit of claim 1, further comprising a controlling sub-circuit, configured to receive the display information or the compensated display information corresponding to each of the plurality of pixels from the compensation processing sub-circuit, and to drive a display panel to display the image based on the display information or the compensated display information corresponding to each of the plurality of pixels.

12. A display apparatus, comprising a display panel, the display panel comprising:

a plurality of pixels in a display region of the display panel; and the circuit of claim 1.

13. The display apparatus of claim 12, further comprising a side-in light source over one side of the display panel and configured to provide substantially parallel lights through the one side into the display panel, wherein:

the plurality of sub-regions in the display panel are arranged in a matrix having rows and columns, wherein the rows are substantially in parallel to, and the columns are substantially perpendicular to, a direction of the lights transmitted in the display panel, wherein:

the compensation processing sub-circuit in the circuit of the display panel is configured to compensate an input voltage of each of the pixels to be lightened in each of the plurality of sub-regions of a same row based on a distance of the each of the pixels to the side-in light source.

14. The display apparatus of claim 13, wherein the compensation processing sub-circuit in the circuit of the display panel is configured to compensate an input voltage of each of the pixels to be lightened in each of the plurality of sub-regions of a same row by at least one of:

reducing an input voltage of a pixel to be lightened relatively close to the side-in light source; or increasing an input voltage of a pixel to be lightened relatively far away from the side-in light source.

15. The display apparatus of claim 13, wherein each of the plurality of pixels in the display panel comprises a primary pixel and at least one compensating pixel, wherein:

the compensation processing sub-circuit in the circuit of the display panel is configured to turn on or off one or more of the at least one compensating pixel to thereby compensate an effective light output area of each of the pixels to be lightened in each of the plurality of sub-regions.

16. The display apparatus of claim 15, wherein:

the compensation processing sub-circuit in the circuit of the display panel is further configured to compensate an effective light output area of each of the pixels to be lightened in each of the plurality of sub-regions of a same row based on a distance of the each of the pixels to the side-in light source.

17. The display apparatus of claim 16, wherein each of the at least one compensating pixel corresponding to the primary pixel has an increased size as a distance of the each of the plurality of pixels to the side-in light source increases, wherein:

the compensation processing sub-circuit in the circuit of the display panel is configured to compensate an effective light output area of each of the pixels to be lightened in each of the plurality of sub-regions by turning on the at least one compensating pixel in a pixel to be lightened.

18. A display apparatus, comprising a display panel, the display panel comprising:

a plurality of pixels in a display region of the display panel; and a circuit for driving the display panel to display an image with an improved homogenization effect, wherein the display panel comprises a plurality of pixels, the circuit comprising an image information extraction sub-circuit and a compensation processing sub-circuit, wherein:

the image information extraction sub-circuit is configured to extract, and to send to the compensation processing sub-circuit, display information corresponding to each of the plurality of pixels based on the image; and the compensation processing sub-circuit is configured:

to divide a display region of the display panel into a plurality of sub-regions;

to obtain, based on the display information of each of the plurality of pixels, an average brightness value of each of the plurality of sub-regions to thereby obtain a group of average brightness values corresponding respectively to the plurality of sub-regions;

to determine whether a compensation is needed for displaying the image based on a uniformity of the group of average brightness values; and if so, to compensate display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved;

the display apparatus further comprising a side-in light source over one side of the display panel and configured to provide substantially parallel lights through the one side into the display panel, wherein:

the plurality of sub-regions in the display panel are arranged in a matrix having rows and columns, wherein the rows are substantially in parallel to, and the columns are substantially perpendicular to, a direction of the lights transmitted in the display panel, wherein:

the compensation processing sub-circuit in the circuit of the display panel is configured to compensate an input voltage of each of the pixels to be lightened in each of the plurality of sub-regions of a same row based on a distance of the each of the pixels to the side-in light source;

wherein each of the plurality of pixels in the display panel comprises a primary pixel and at least one compensating pixel, wherein:

the compensation processing sub-circuit in the circuit of the display panel is further configured to turn on or off one or more of the at least one compensating pixel to thereby compensate an effective light output area of each of the pixels to be lightened in each of the plurality of sub-regions;

wherein:

the compensation processing sub-circuit in the circuit of the display panel is further configured to compensate an effective light output area of each of the pixels to be lightened in each of the plurality of sub-regions of a same row based on a distance of the each of the pixels to the side-in light source;

wherein each of the plurality of pixels comprises a primary pixel and a plurality of compensating pixels, each of the plurality of compensating pixels having a substantially equal size, wherein:

the compensation processing sub-circuit in the circuit of the display panel is configured to compensate an effective light output area of each of the pixels to be lightened in each of the plurality of sub-regions by turning on an increased number of compensating pixels corresponding to a pixel to be lightened as a distance of the pixel to be lightened to the side-in light source increases.

19. A method for adjusting display brightness level of a display panel comprising a plurality of pixels, comprising:

extracting display information corresponding to each of the plurality of pixels from an image to be displayed in the display panel;

dividing a display region of the display panel into a plurality of sub-regions, wherein each of the plurality of sub-regions comprises at least one pixel;

obtaining an average brightness value of each of the plurality of sub-regions based on the display information of each of the plurality of pixels to thereby obtain a group of average brightness values corresponding respectively to the plurality of sub-regions;

determining whether a compensation is needed for displaying the image based on a uniformity of the group of average brightness values; and if so, compensating display brightness levels of each of the pixels to be lightened in each of the plurality of sub-regions to thereby obtain compensated display information corresponding to each of the plurality of pixels such that the uniformity of the group of average brightness values corresponding respectively to the plurality of sub-regions is improved;

the method further comprising storing a pre-stored average brightness value look-up table, wherein said obtaining the average brightness value of each of the plurality of sub-regions comprises:

calculating a ratio of pixels to be lightened in each of the plurality of sub-regions based on the display information of each of the plurality of pixels; and then querying the ratio of pixels to be lightened in each of the plurality of sub-regions in the pre-stored average brightness value look-up table in the storage sub-circuit.

* * * * *